US006595906B2

(12) United States Patent
Smith

(10) Patent No.: US 6,595,906 B2
(45) Date of Patent: Jul. 22, 2003

(54) LEG STRETCH EXERCISE DEVICE

(76) Inventor: Duane E. Smith, 123 Compton Dr., Attleboro, MA (US) 02703

( * ) Notice: Subject to any disclaimer, the term of this patent is extended or adjusted under 35 U.S.C. 154(b) by 243 days.

(21) Appl. No.: 09/840,565

(22) Filed: Apr. 23, 2001

(65) Prior Publication Data

US 2001/0016540 A1 Aug. 23, 2001

Related U.S. Application Data

(60) Continuation of application No. 09/391,645, filed on Sep. 7, 1999, now Pat. No. 6,270,448, which is a division of application No. 08/906,667, filed on Aug. 7, 1997, now Pat. No. 5,997,451.

(60) Provisional application No. 60/022,447, filed on Aug. 7, 1996.

(51) Int. Cl.[7] ..... A63H 13/02

(52) U.S. Cl. ..... 482/907; 482/148; 482/907

(58) Field of Search ..... 482/907, 148, 482/129, 122, 69, 904, 128, 908, 108

(56) References Cited

U.S. PATENT DOCUMENTS 4,781,373 A * 11/1988 Irwin ..... 482/907
4,895,543 A * 1/1990 Vermette ..... 482/907
5,118,101 A * 6/1992 Belli ..... 482/52
5,318,445 A * 6/1994 Meier et al. ..... 482/129
6,110,083 A * 8/2000 Riser ..... 482/142

* cited by examiner

*Primary Examiner*—Jerome W. Donnelly
(74) *Attorney, Agent, or Firm*—Steven N. Fox, Esq.

(57) ABSTRACT

A device for allowing a person to perform one or more leg stretch exercises. In one embodiment, the device comprises first and second bracket members. Each of the first and second bracket members comprise first and second support members and an upper support member. The upper support member of said first bracket member is connected to the first and second support members of the first bracket member. The upper support member of the second bracket member is connected to the first and second support members of the second bracket members. The upper support member of the first bracket member is engageable with the upper support member of the second bracket member to a use position where the first bracket member is substantially perpendicular to the second bracket member. First and second leg support members are removably engaged with the first and second support members of the first bracket member to support the leg of the person. Third and fourth leg support members are removably engaged with the first and second support members of the second bracket member to support the leg of the person. First and second handle members are removably engaged with the first and second support members of the first bracket member, respectively, to provide a structure for the person's hand to grasp and/or hold. Third and fourth handle members are removably engaged with the first and second support members of the second bracket member, respectively, to provide a structure for the person's hand to grasp and/or hold.

15 Claims, 19 Drawing Sheets

LEG STRETCH EXERCISE DEVICE

CROSS-REFERENCE TO RELATED APPLICATIONS

This application is a continuation of application of and claims priority to application Ser. No. 09/391,645, filed Sep. 7, 1999 now, U.S. Pat. No. 6,270,448 which is a divisional application of application Ser. No. 08/906,667, filed on Aug. 7, 1997, now U.S. Pat. No. 5,997,451, which claims benefit to provisional application Ser. No. 60/022,447 filed on Aug. 7, 1996.

BACKGROUND OF THE INVENTION

The present invention relates generally to field of exercise equipment.

Stretching of the major leg muscles such as the quadriceps, inner thighs, and calves are important for many reasons. Stretching of such muscles increases flexibility and reduces the risk of injury during strenuous use of the muscles, incurred, for example, while playing sports or lifting weights. Conventional stretching devices do not allow a person to stretch all of the major muscles on a single device that can be used by a person in an easy, comfortable, and efficient manner.

BRIEF SUMMARY OF THE INVENTION

A device for allowing a person to perform one or more leg stretch exercises. In one embodiment, the device comprises first and second bracket members. Each of the first and second bracket members comprise first and second support members and an upper support member. The upper support member of said first bracket member is connected to the first and second support members of the first bracket member. The upper support member of the second bracket member is connected to the first and second support members of the second bracket members. The upper support member of the first bracket member is engageable with the upper support member of the second bracket member to a use position where the first bracket member is substantially perpendicular to the second bracket member. First and second leg support members are removably engaged with the first and second support members of the first bracket member to support the leg of the person. Third and fourth leg support members are removably engaged with the first and second support members of the second bracket member to support the leg of the person. First and second handle members are removably engaged with the first and second support members of the first bracket member, respectively, to provide a structure for the person's hand to grasp and/or hold. Third and fourth handle members are removably engaged with the first and second support members of the second bracket member, respectively, to provide a structure for the person's hand to grasp and/or hold.

BRIEF DESCRIPTION OF THE DRAWINGS

The following detailed description of the present invention will be more fully understood with reference to the accompanying drawings in which.

DETAILED DESCRIPTION OF THE PREFERRED EMBODIMENTS

Figure 1:
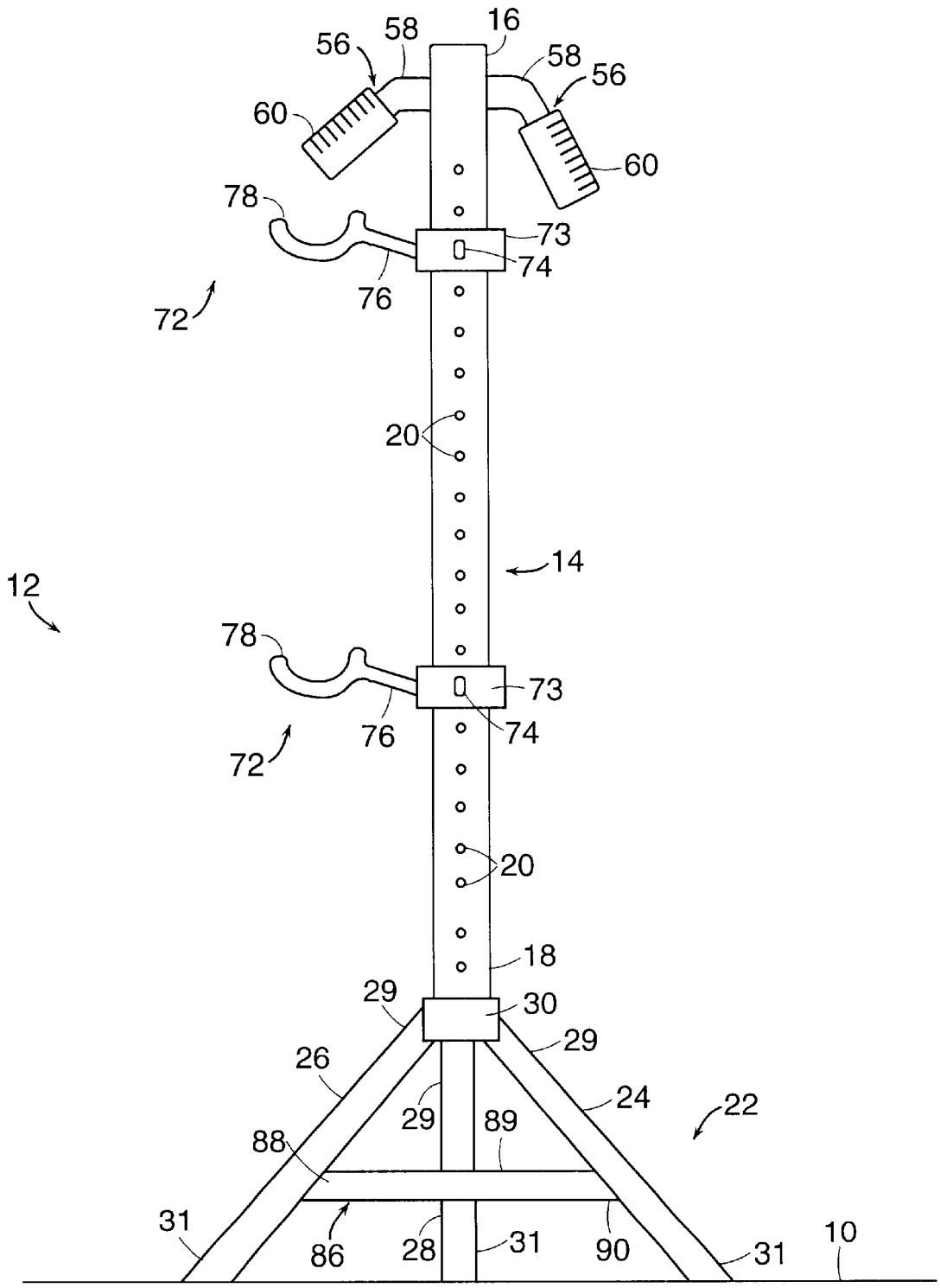
FIG. 1 is an elevation view of a first embodiment of the stretching device.

Referring to FIG. 1 wherein a first embodiment of the leg stretching device 12 is shown disposed on a support surface or floor 10. The first embodiment of the leg stretching device 12 is intended for use by a single person. The first embodiment of the stretching device 10 generally comprises a support member 14 which is vertically supported on the floor 12 by a base member 22, a plurality of leg support members 72, a plurality of handle members 56, a and a for support member 86.

Figure 2:
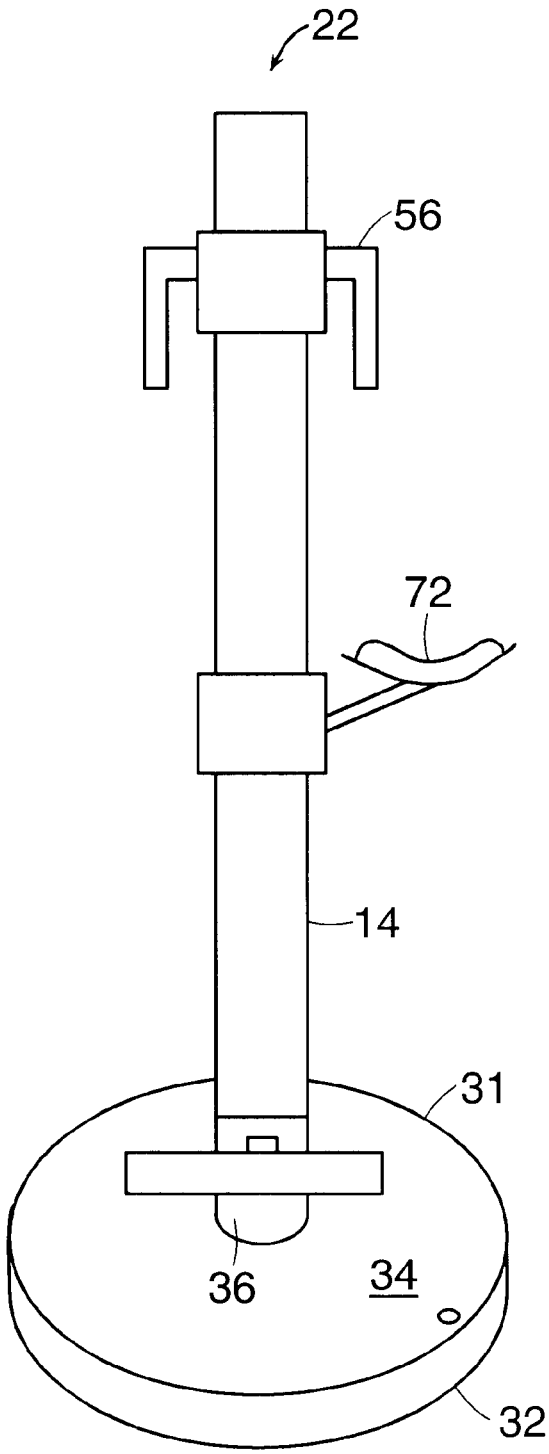
FIG. 2 is a perspective view of a base member.
Figure 3:
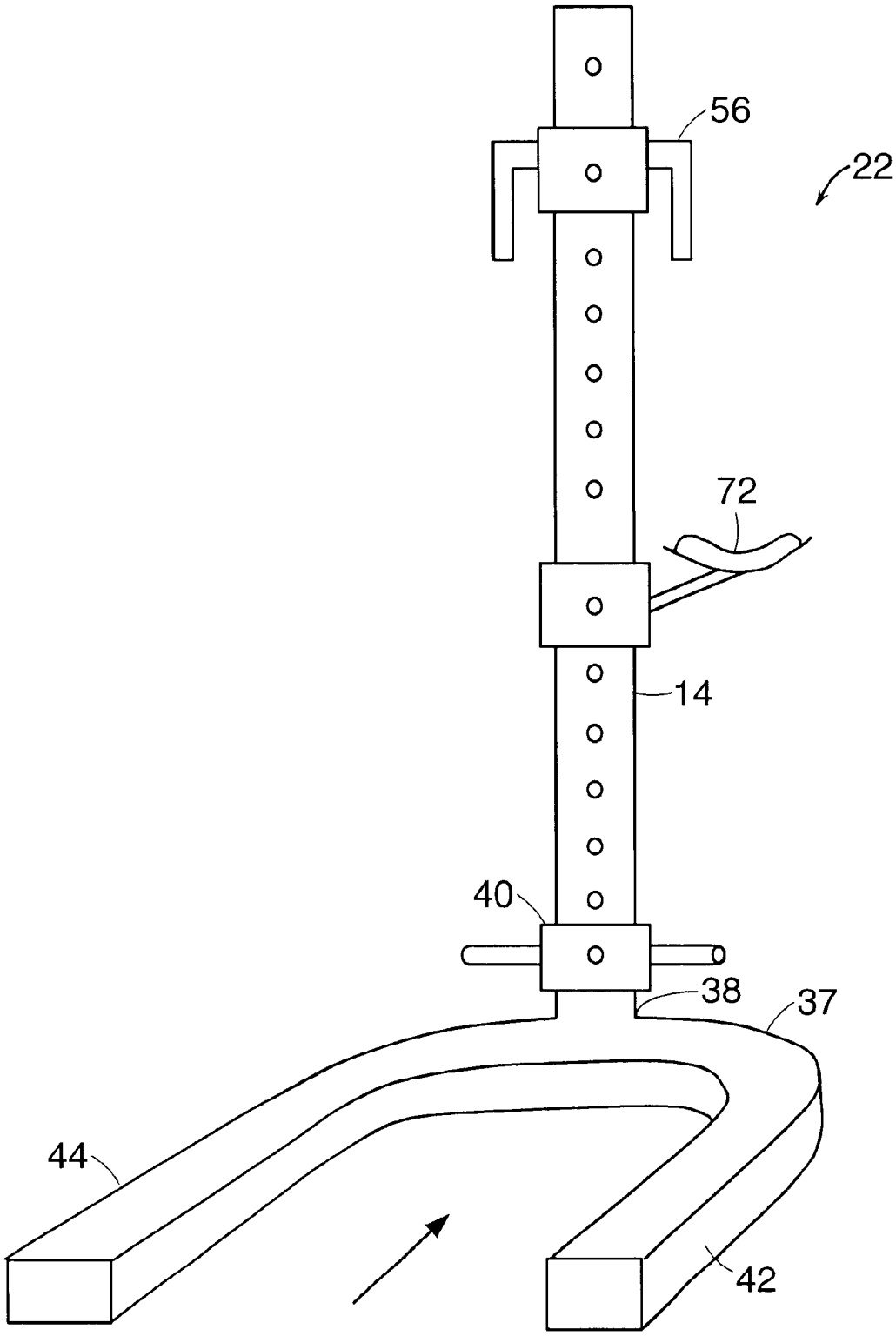
FIG. 3 is a perspective view of a base member.
Figure 4:
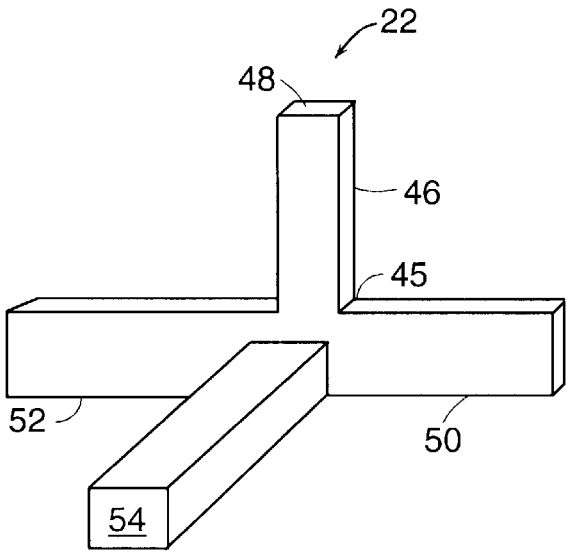
FIG. 4 is a perspective view of a base member.
Figure 5:
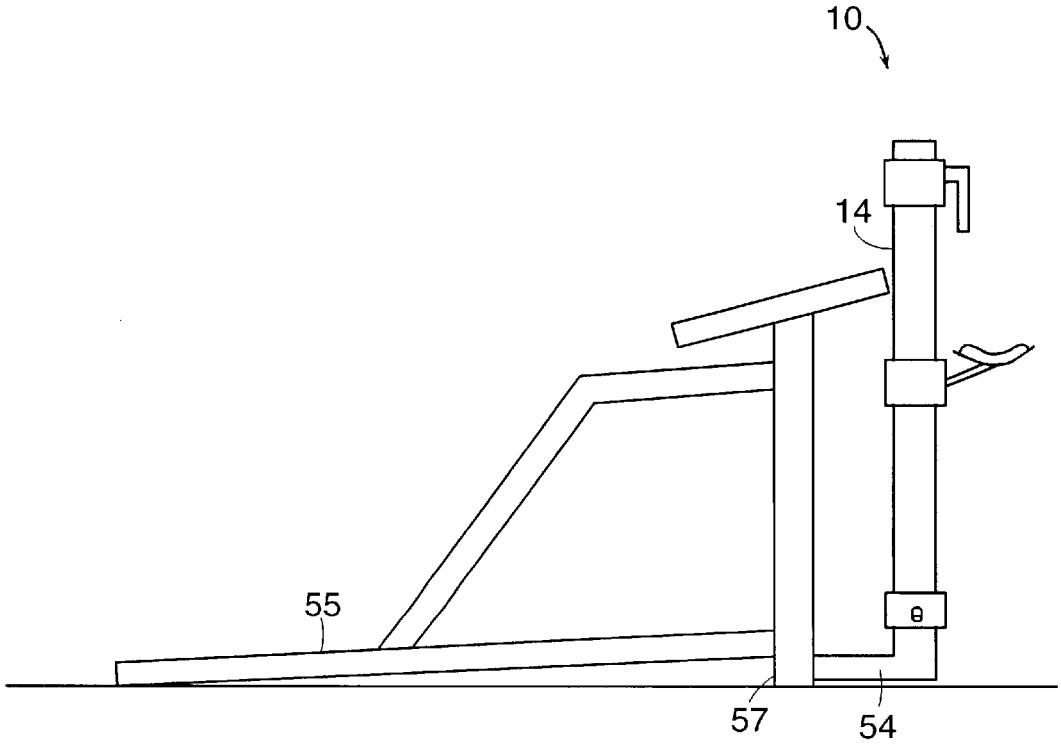
FIG. 5 is a perspective view of the present invention engaged with a secondary piece of exercise equipment such as a tread mill.

The support member 14 comprises a first end portion 16 and a second end portion 18, and a plurality of spaced mounting holes 24. In the embodiment of FIG. 1, the base member 22 comprises a first leg 24, a second leg 26 a third leg 28 and a mounting bracket 30 integrally formed into a tripod configuration. Each of the legs 24, 26, and 28 have a first and portion 29 connected to the mounting bracket 30 and a second end portion 31 which is contact with the floor 10. The base member 22 may be takes a variety of forms and configurations. By way of example only, FIG. 2 shows the base member 22 in the form of a circular shaped housing 31 having a bottom surface 32 a top surface 34 and a mounting bracket 30. FIG. 3 shows the base member 22 in the form of a U-shaped housing 37 having a vertical support member 38, a mounting bracket 40, a first leg portion 42 and a second leg portion 44. FIG. 4 shows the base member 22 in the form a T-shaped housing 45 having a vertical support member 46, a mounting bracket 48, a first leg portion 50, a second leg portion 52, and a third leg portion 54. In this embodiment, the base member 22 allows the stretching device 10 to be attached to a secondary exercise apparatus 55 such as tread mill by attaching the third leg 54 to a platform or mounting bracket 57 of the secondary exercise apparatus 55.

Figure 6:
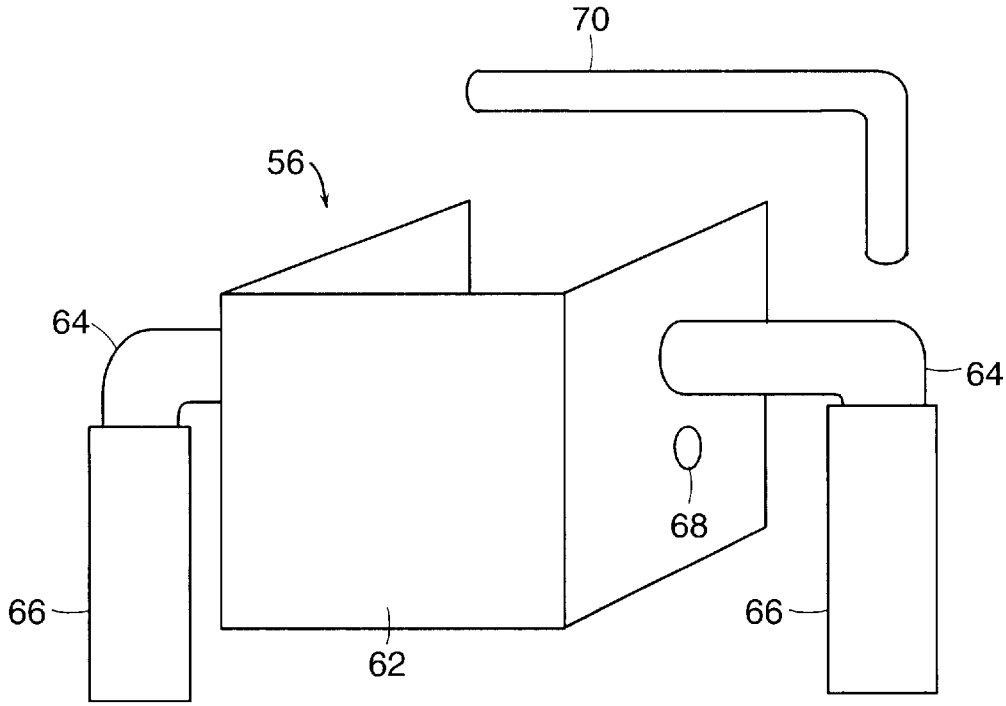
FIG. 6 is a perspective view of an adjustable handle support.

The handle members 56 comprises a rigid support or extension member 58 having a first end securely connected by conventional means to the first end portion 16 of the support member 14. The handle members 56 each further comprise a handle portion 60 preferably of a comfortable polymer material which disposed about the opposite end of the rigid support of extension member 58. Handle members 56 are adapted to be easily and comfortable grasped by the person. The handle members 56 may take a variety of forms and configurations. By way of example only, and although show in FIG. 1 as being fixed to the support member 14, the handle member 56 s shown in FIG. 6 may be adjustable mounted at various portion of the support member 14. In this embodiment, the handle member 56 comprises a bracket member 62, a rigid support 64, a handle portion 66, mounting openings 68 and a pin 70. The handle member 56 is adjustable selected at various positions along the support member 14 by passing pin 70 through mounting openings 68 and through any one of the mounting openings 20 of the support member 14. With this embodiment, the user may selected a comfortable height for the handle members 56.

Figure 7:
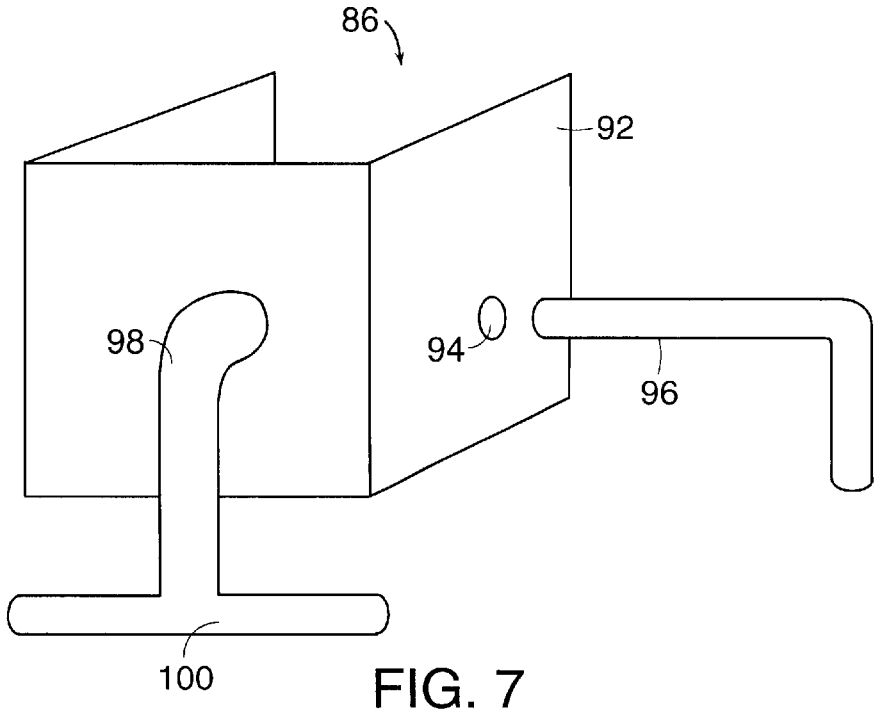
FIG. 7 is a perspective view of an adjustable foot support.
Figure 8:
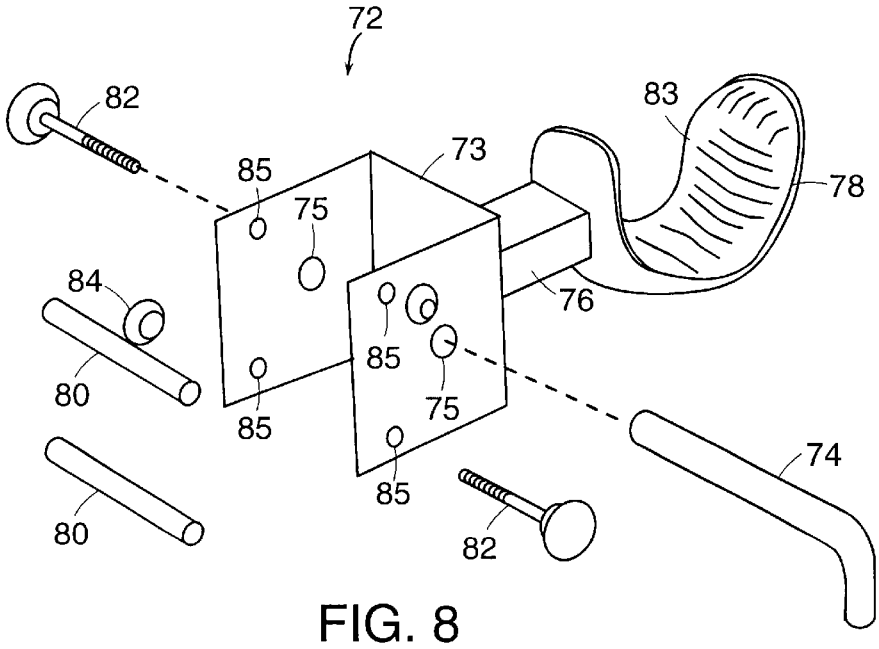
FIG. 8 is a perspective view of a leg support.

As shown in FIG. 1, the foot support member 86 generally comprises a first end portion 88, a second end portion 90, and a foot mounting portion 89. The first and second end portions 88 and 90 are attached to and spans across legs 26 and 24 of the base member 22, respectively. The leg support member 86 is adapted to support the weight of a person using the stretching device 10.The handle members 56 may take a variety of forms and configurations. By way of example only, and although show in FIG. 1 as being fixed to the base member 22, the foot support member 86 as shown in FIG. 7 may be adjustable mounted at various portions along the support member 14. In this embodiment, the foot support member 86 comprises a bracket member 92, a mounting openings 94, a pin 96, a extension portion 98 and a foot mounting portion 100. The foot support member 86 is adjustable selected at various positions along the support member 14 by passing pin 96 through mounting openings 94 and through any one of the mounting openings 20 of the support member 14. With this embodiment, the user may selected a comfortable height for the foot support member 86.

Each of leg support members 72 may be selectively position along the vertical height of the support member 14 at any one of the openings 20. Each of the leg support members 72 generally comprise a collar or bracket portion 72 encircling the support member 14, an arm or extension portion 76 connected securely to and extending outward from the bracket 72, and a leg support portion 78 connected securely to and extending outward from the extension portion 76. Each of the leg support portion 78 are preferably of arcuate shape opening upwardly open such that a persons leg may be securely supported therein. Each of the leg support portions 78 are preferably provided with pad or cushion material 83 for comfort. Each of the leg supports 78 may be secured at a selected position along the support member 14 by use of a pin 74 which is passed through openings 75 in the bracket 73 and one of selected mounting holes 20.

The leg support member 72 may take a variety of forms and configurations. By way of example only, the leg support member 72 may comprise a one or mor retention members 80 which are adapted to prevent the leg support member 72 on the support member 14 while the user removes to the pin 74 top re-position the leg support member and to allow the leg support member 72 to easily roll or slide along the support member 14. The retention member 80 is preferably of a cylindrical hollow shape and is freely mounted to the bracket 73 by conventional means such as a bolt 82 passing through the internal cylindrical cavity of the retention member 80 and being secured by nut 84. With the is design, the retention member 80 is free to rotate as the leg support member 72 is moved along the support member 14.

Figure 9:
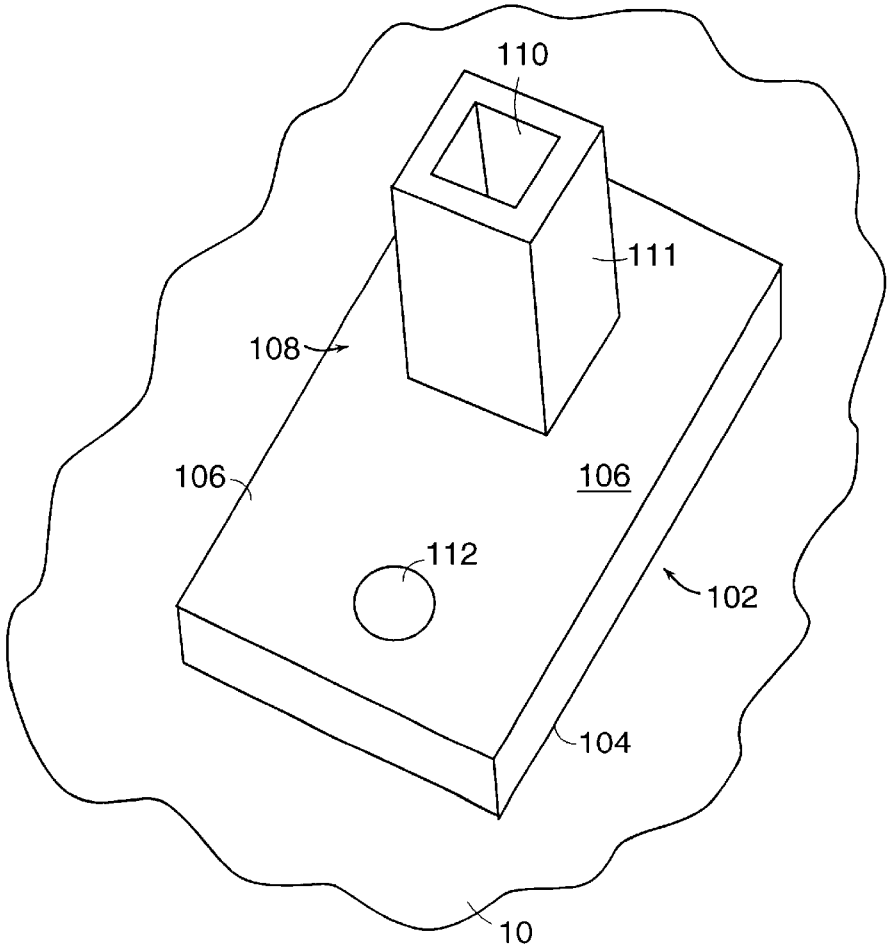
FIG. 9 is a perspective view of a base support.

As shown in FIG. 9, the stretching device 10 of the first embodiment may further comprise a base support member 102 securely engageable with the legs 24, 26, and 28 of the base member 22 to thereby provide increased stability for the stretching device 10 during use. Each of the base support members 102 comprise a bottom surface 104, a top surface 106 and a mounting bracket 108 extending upward from the top surface 106 and adapted to securely receive the second end portions 31 of legs 24, 26, and 28. Second end portions 31 of the legs 24. 26, and 28 and mounting bracket 108 may be mutually designed such that the second end portions 31 of legs 24, 26, and 28 encase the outer surface 11 of the mounting bracket member 108 or such that the second end portions 31 of legs 24, 26, and 28 slide within a channel recess 110 formed within the mounting bracket 108. The bottom surface 104 is preferably substantially planar to provide a stable support on the floor 10. Each of the base supports 102 may further comprise a mounting hole 112 which is adapted to allow a fastener such as a bolt or screw to secure the base support 102 to the floor 10.

Figure 10:
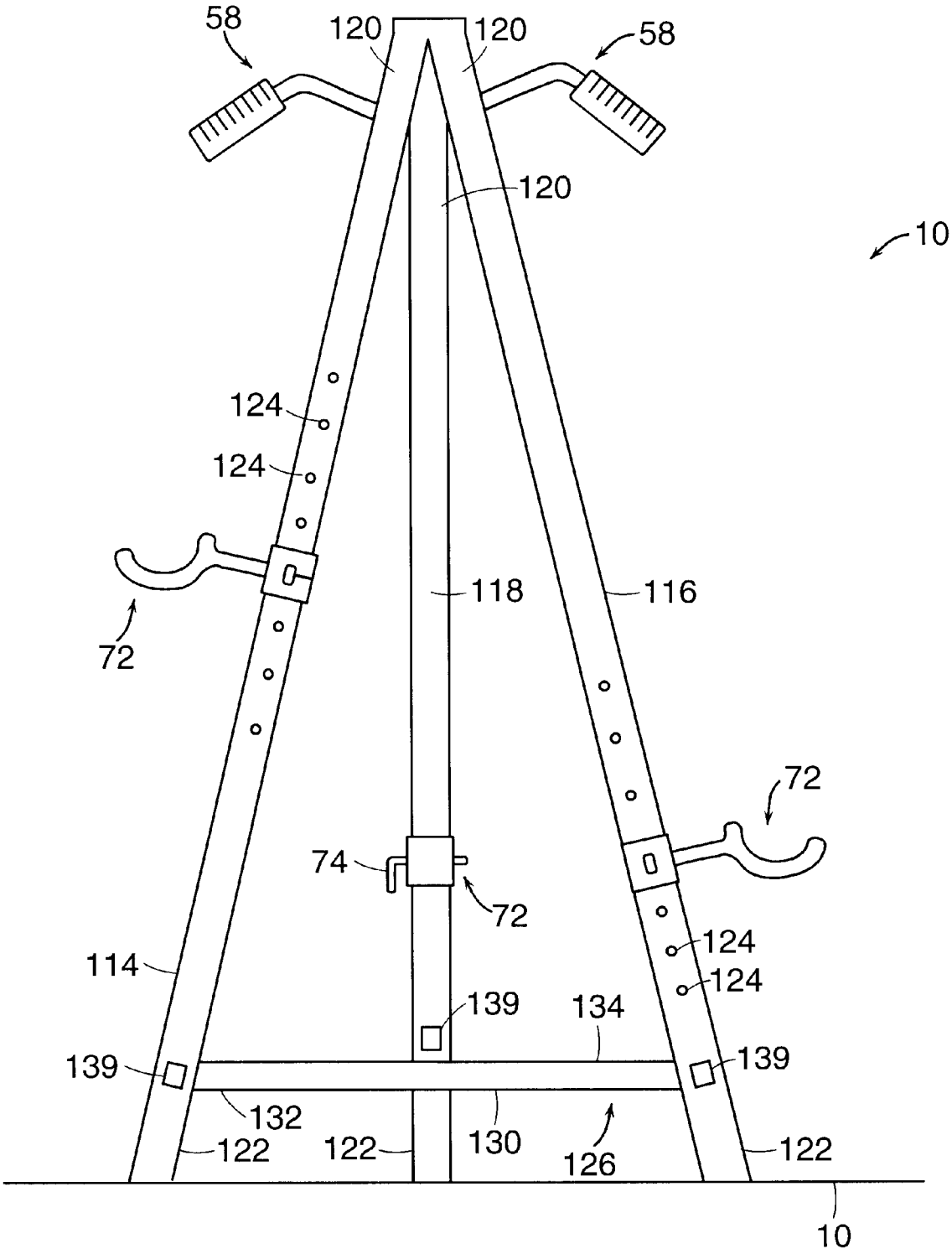
FIG. 10 is an elevation view of a second embodiment of the stretching device.

Referring to FIG. 10, wherein a second embodiment of the stretching device 10 is shown having a three (3) support members 114,116, and 118. Each of the support members 114, 116, and 118 have a upper end portion 120 and a lower end portion 122 and a plurality of mounting holes disposed along the support member 114, 116, and 118. In the embodiment of FIG. 10, the upper end portions 120 of support member 114, 116 and 118 are securely connected together to provide a non-collapsible structure. In the embodiment of FIG. 10, the stretching device may further comprise three (3) foot support members 126 (only one is shown) having an upper mounting portion 130 and first and second end portions 132 and 134. Each of the first and second end portions 132 and 134 are connected securely and fixed to the lower end portions 122 of support members 114 and 116, support members 116 and 118 (not shown), and support members 118 and 114 (not shown). The foot support is adapted to allow the user to support his weight and to provide additional stability to the support members 114, 116, and 118.

Figure 11:
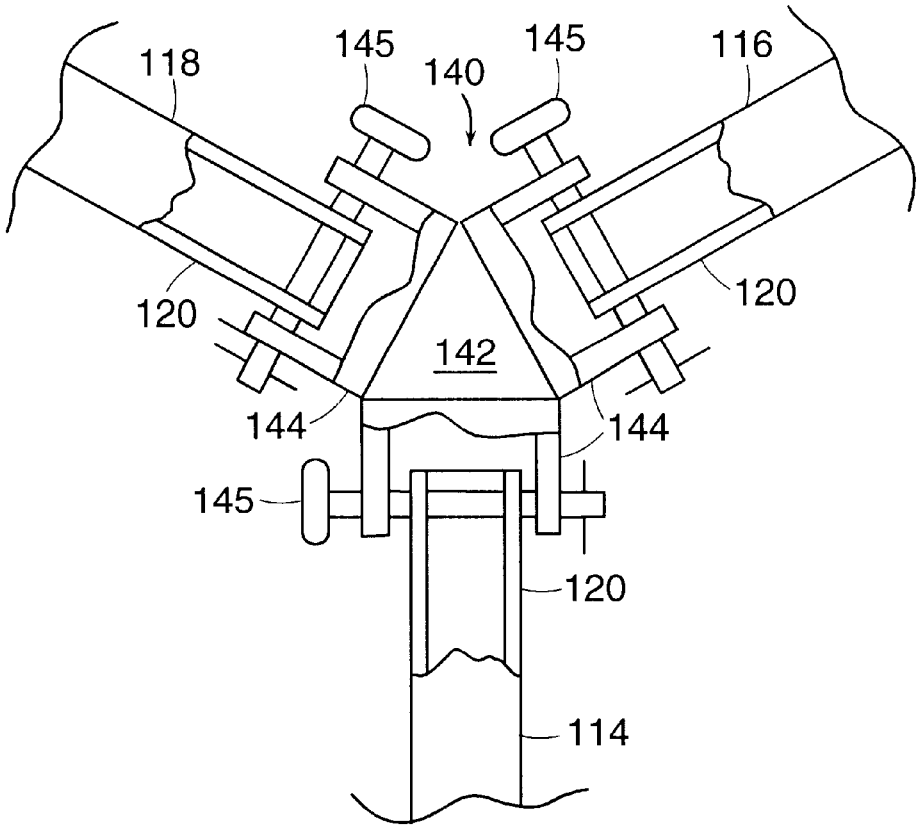
FIG. 11 is partial top view of the second embodiment of the stretching device.

The stretching device 12 of the second embodiment (FIG. 10) may be designed in a variety of ways. By way of example only, the stretching device 12 may be designed such that the user can easily fold or collapse the stretching device 12 for storage and unfold or extend the stretching device 12 when use is desired. As shown in FIG. 11, the stretching device 10 may further comprise a fixed mounting bracket 140 having a central housing portion 142 and three (3) bracket members 144 extending outward therefrom. The upper end portions 120 of support members 114, 116, and 118 are rotatably connected to the bracket member 144 from an inward or storage position (not shown) to an outward or use position (FIG. 10). As shown in FIG. 11, the foot support member 126 may alternatively be removably attached to the support members 114 and 166. In this embodiment, the foot support member 126 further comprises engagement members or protrusions 136 and 138 extending downward from the first and second end portions 132 and 134, respectively. The engagement members 136 and 138 are adapted to removably and securely engagement with mounting brackets 139 provided at the lower portion 122 and on both sides of the support members 114, 116, and 118 (mounting bracket 139 is shown on only one side of support members 114, 116, and 118).

Referring to FIGS. 13–16, wherein a third embodiment of the stretching device 12 is shown. In this embodiment, the stretching device 12 generally comprises first and second angle brackets 146 and 180 which when connected together form the basic structure of the stretching device 12. As in the other embodiments, the stretching device 12 also comprises handle members 58 and leg support members 72, and foot support members 126.

The first angle bracket 146 generally comprises a first support member 148, a second support member 158, an upper support bracket 168 and a lower support bracket 174. The first support member 148 generally comprises an upper end portion 150, a lower end portion 152, a plurality of mounting holes 154 disposed along the support member 148, and a mounting bracket 156 (only one shown) disposed on both sides of the lower end portion 152 of the first support member 148. The second support member 158 generally comprises an upper end portion 160, a lower end portion 162, a plurality of mounting holes 164 disposed along the support member 158, and a mounting bracket 166 (only one shown) disposed on both sides of the lower end portion 152 of the first support member 158. The upper support bracket 168 generally comprises a first end portion 170 and a second end portion 172. The end portion 170 is securely connected by conventional means (such as welding) to the upper end portion 160 of the support member 160, while the second end portion 172 is connected by conventional means (such as welding) to the upper end portion 150 of the support member 148. The upper support bracket 168 comprises a through hole 169 which as will be hereinafter describe dis used to connect angle brackets 146 and 180. The lower support bracket 174 generally comprises a first end portion 176 and a second end portion 178. The end portion 176 is securely connected by conventional means (such as welding) to the lower end portion 162 of the support member 160, while the second end portion 178 is connected by conventional means (such as welding) to the lower end portion 152 of the support member 148. The lower support bracket 174 comprises a through hole 175 which as will be hereinafter describe dis used to connect angle brackets 146 and 180.

The second angle bracket 180 generally comprises a first support member 182, a second support member 200, an upper support bracket 210 and a lower support bracket 216. The first support member 182 generally comprises an upper end portion 184, a lower end portion 186, a plurality of mounting holes 188 disposed along the support member 182, and a mounting bracket 190 (only one shown) disposed on both sides of the lower end portion 186 of the first support member 182. The second support member 200 generally comprises an upper end portion 202, a lower end portion 204, a plurality of mounting holes 206 disposed along the support member 200, and a mounting bracket 208 (only one shown) disposed on both sides of the lower end portion 204 of the support member 200. The upper support bracket 210 generally comprises a first end portion 212 and a second end portion 214. The end portion 212 is removebaly connected by conventional means (such as bolts and nuts) to the upper end portion 202 of the support member 200, while the second end portion 214 is removeably connected by conventional means (such as nuts and bolts) to the upper end portion 184 of the support member 182. The upper support bracket 210 comprises a through hole 211 which as will be hereinafter describe dis used to connect angle brackets 146 and 180. The lower support bracket 216 generally comprises a first end portion 218 and a second end portion 220. The end portion 216 is securely connected by conventional means (such as welding) to the lower end portion 204 of the support member 200, while the second end portion 220 is connected by conventional means (such as welding) to the lower end portion 186 of the support member 182. The lower support bracket 216 comprises a through hole 217 which as will be hereinafter describe dis used to connect angle brackets 146 and 180.

Figure 12:
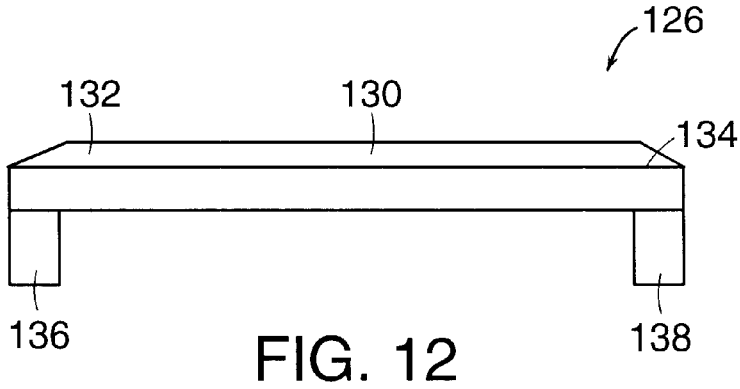
FIG. 12 is a perspective view of a fixed foot support.
Figure 13:
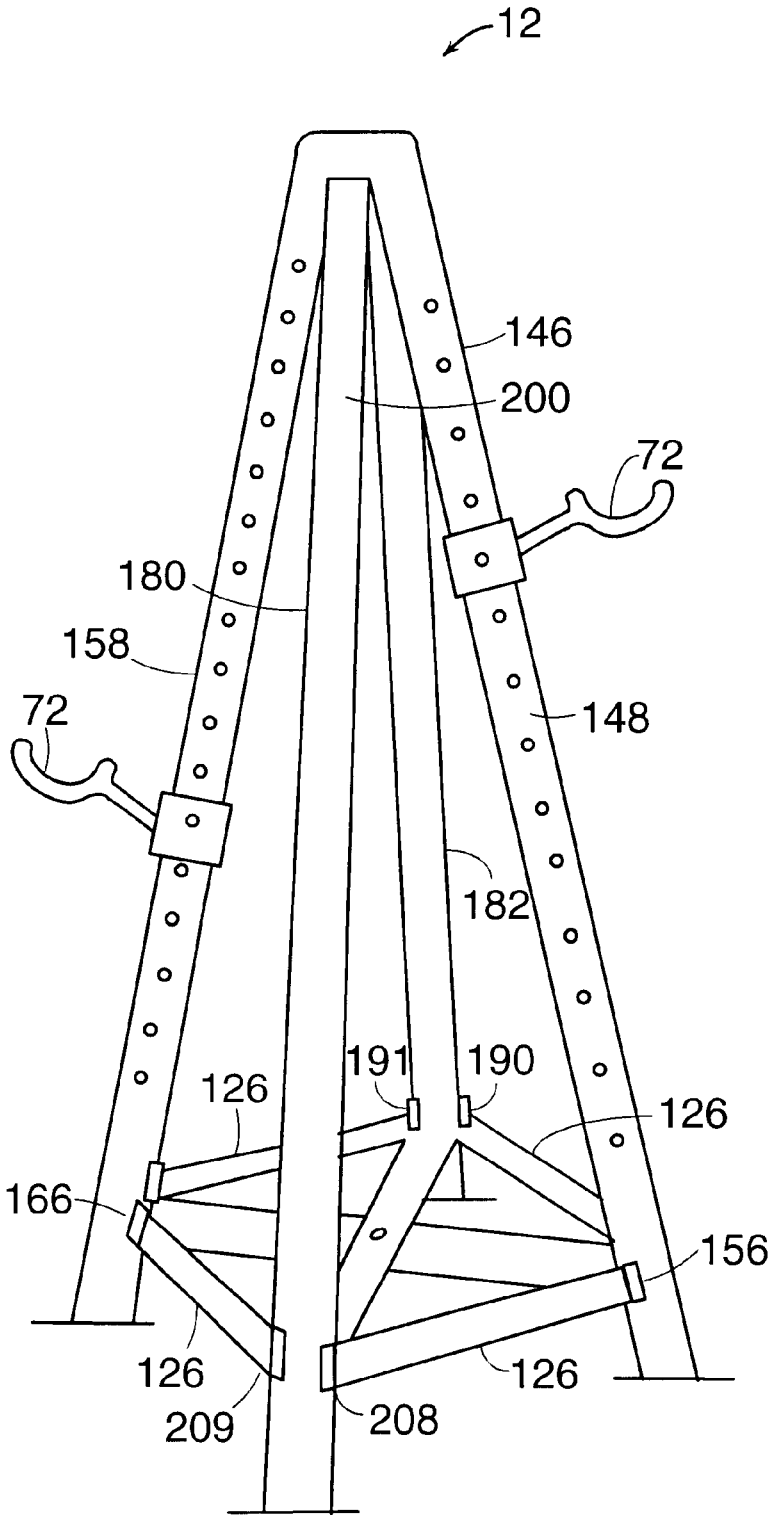
FIGS. 13 and 14 are perspective views of a third embodiment of the stretching device.
Figure 14:
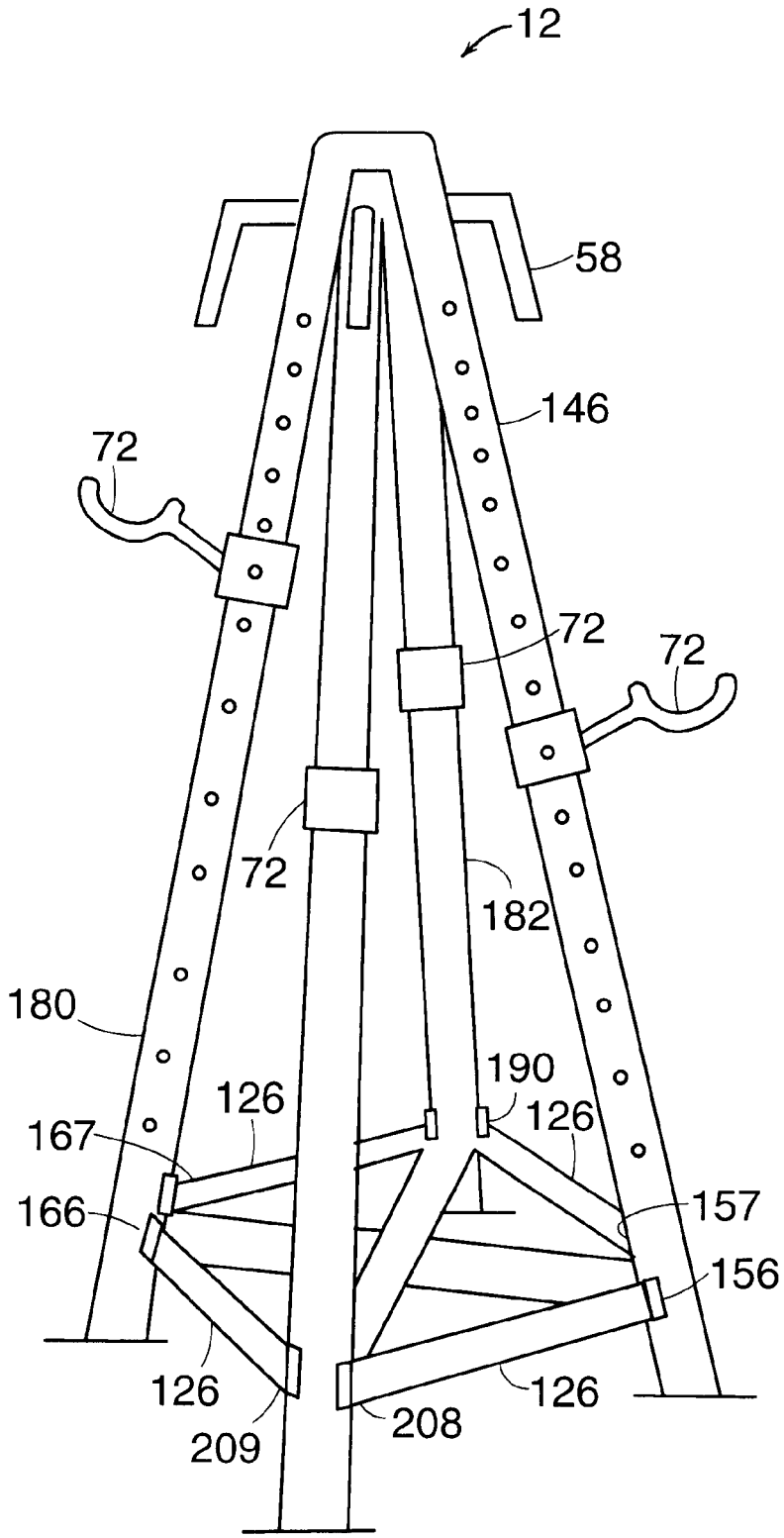
Figure 15:
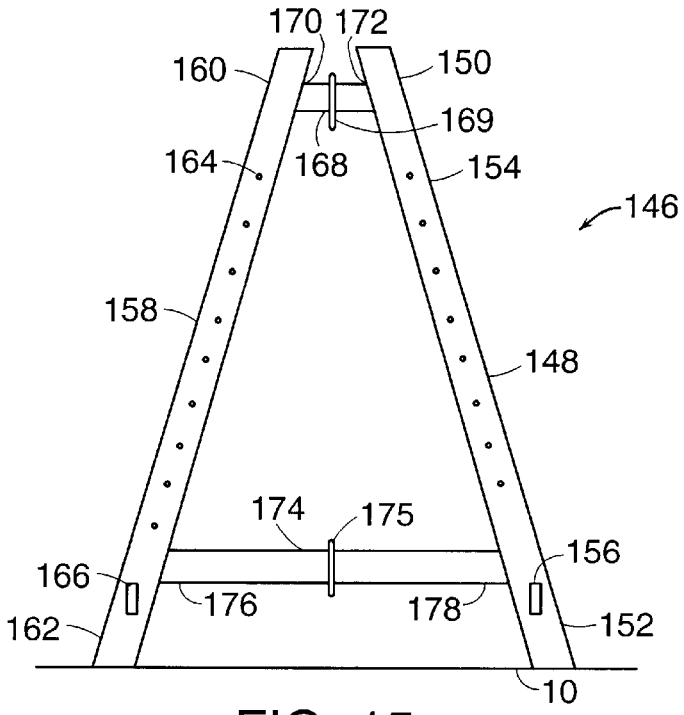
FIGS. 15 and 16 are elevation views of the angle brackets of the third embodiment.
Figure 16:
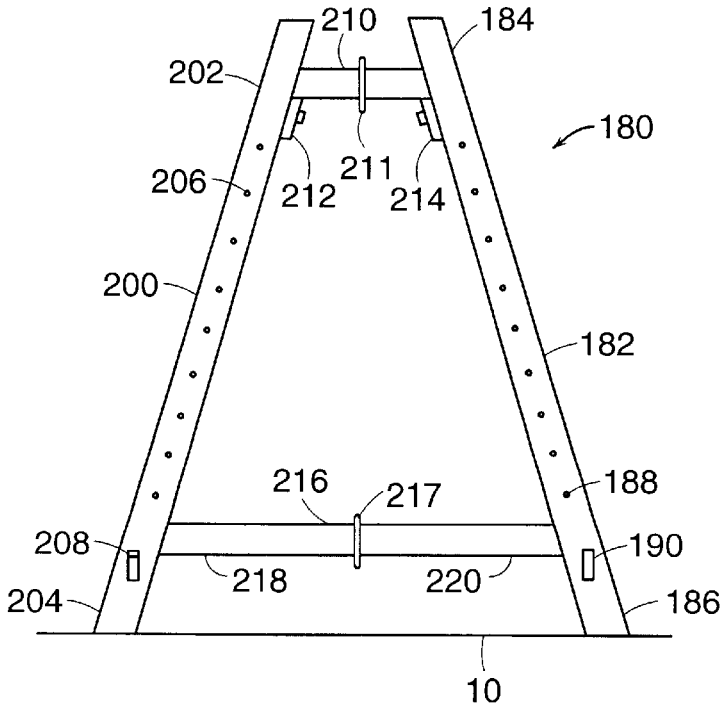
Figure 17C:
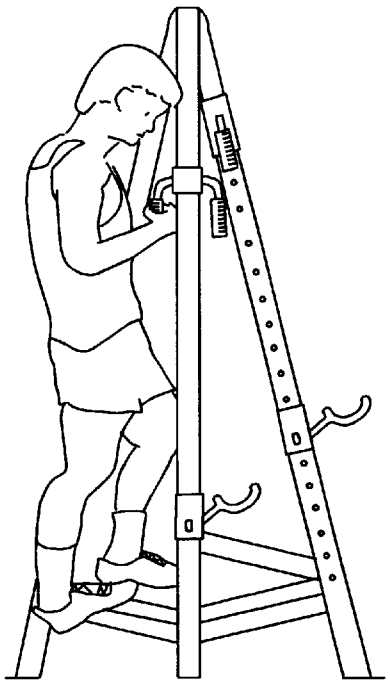
FIGS. 17 and 18 are various views showing a person performing various exercises in connection with the present invention.
Figure 17B:
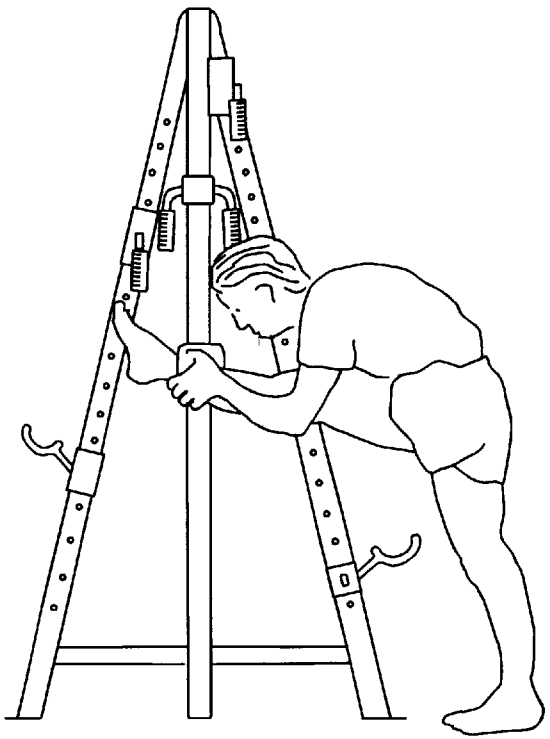
Figure 17A:
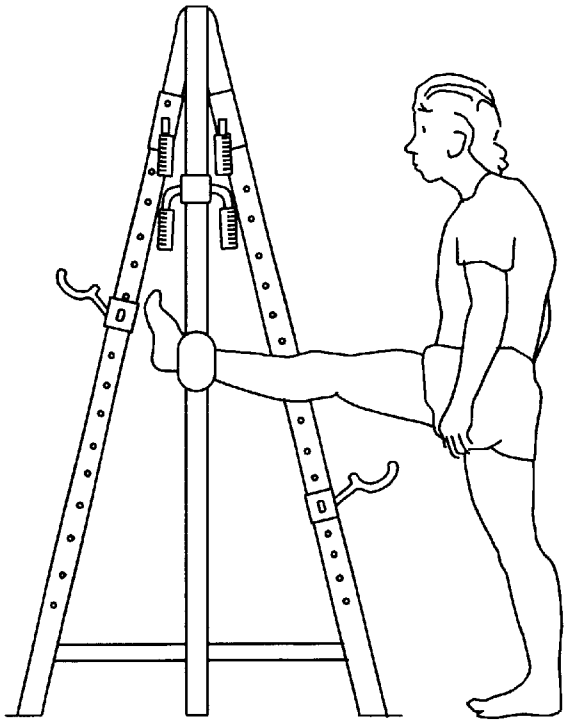
Figure 17F:
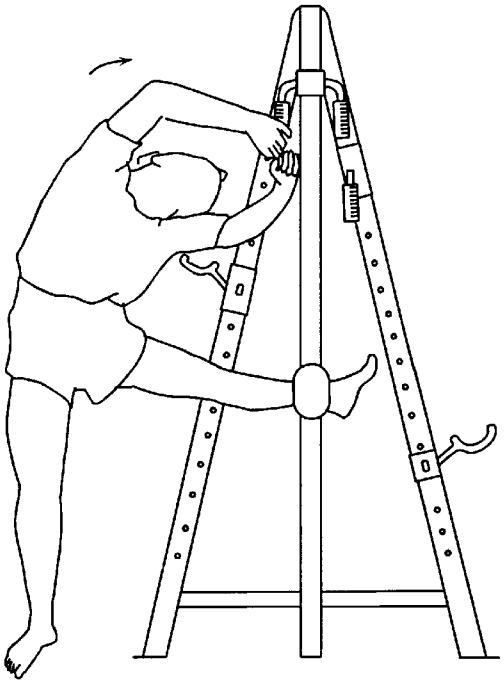
Figure 17E:
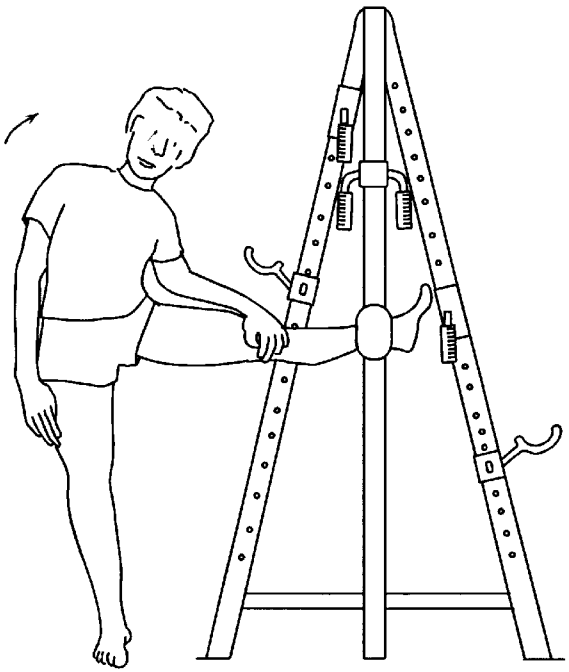
Figure 17D:
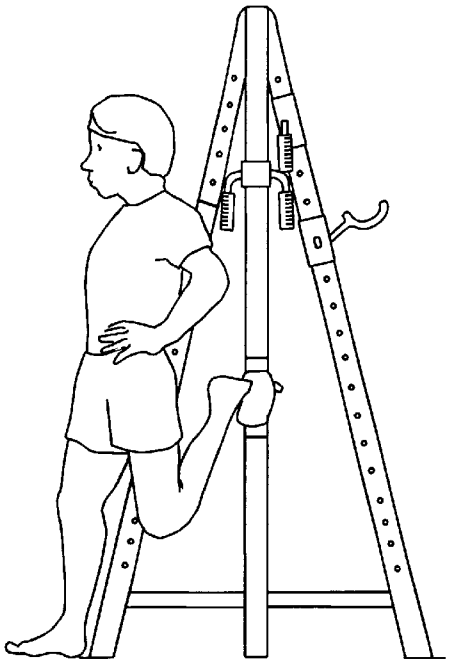
Figure 17H:
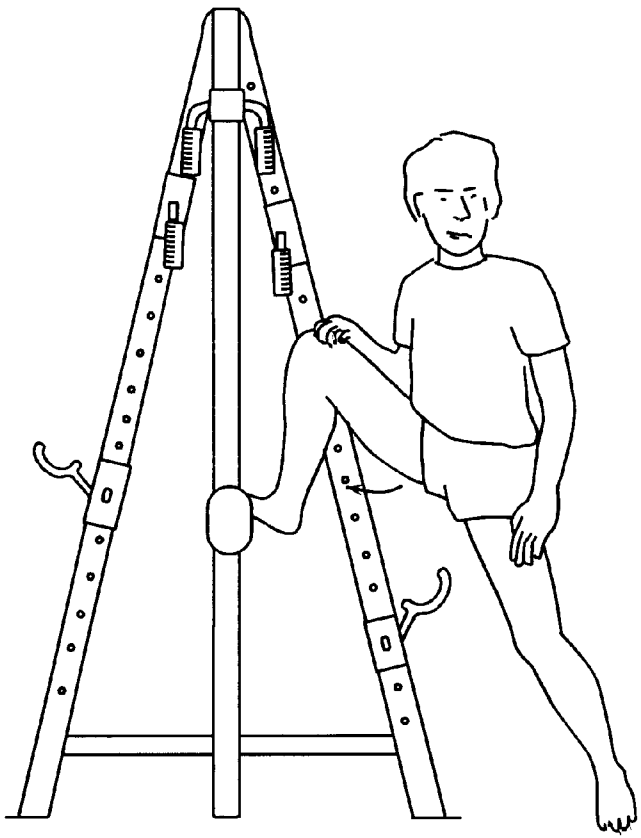
Figure 17G:
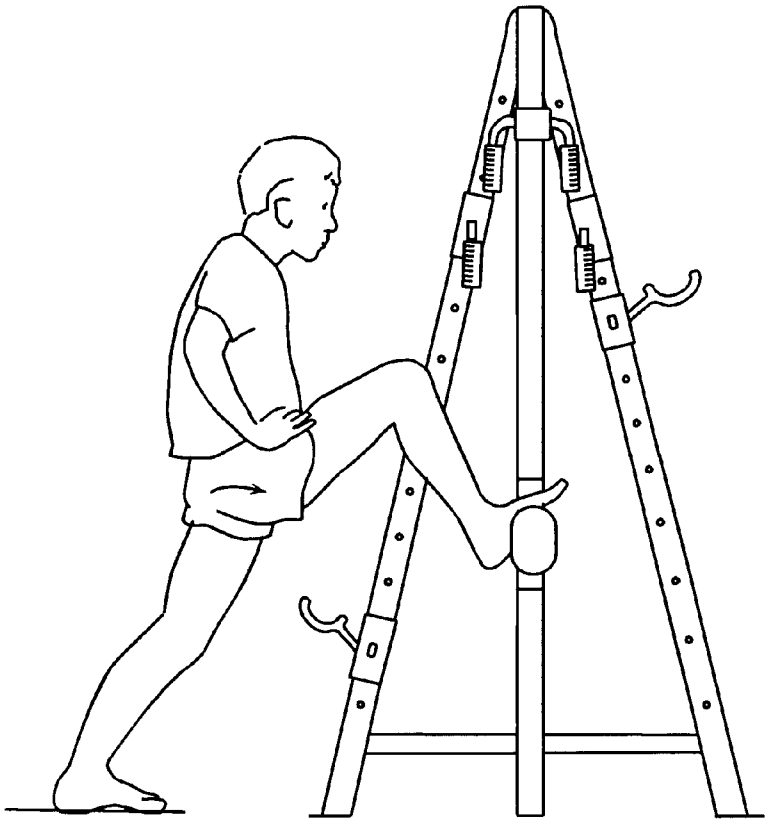
Figure 18C:
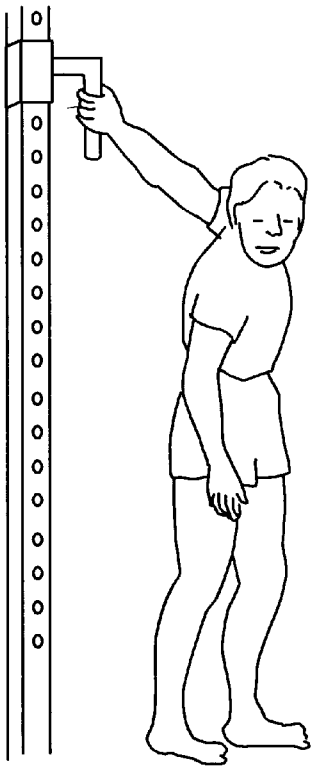
Figure 18B:
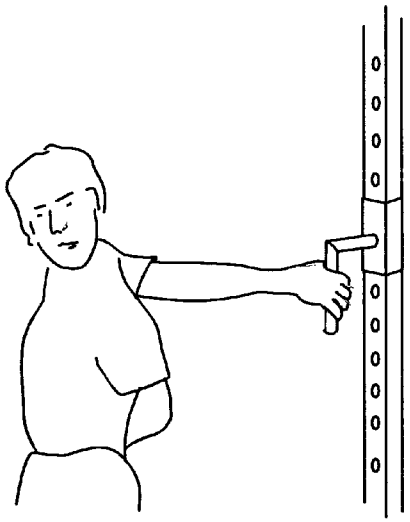
Figure 18A:
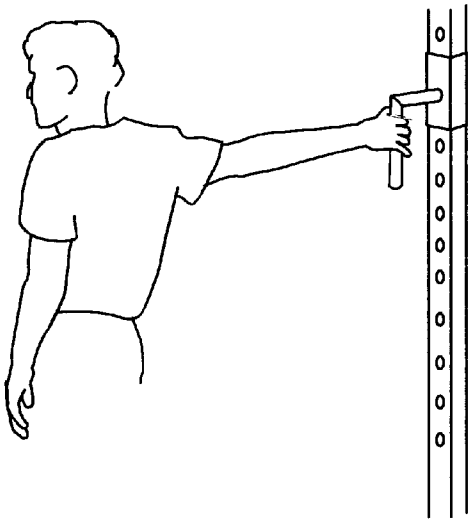
Figure 18F:
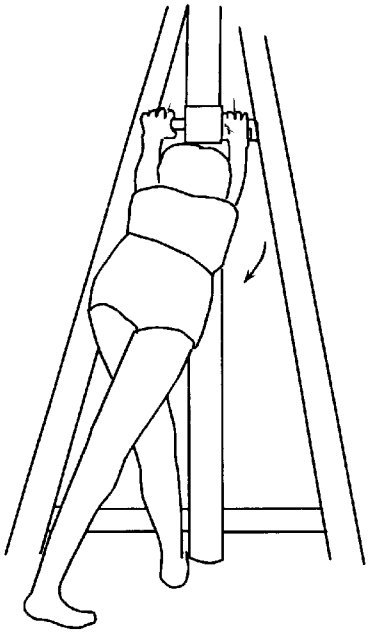
Figure 18E:
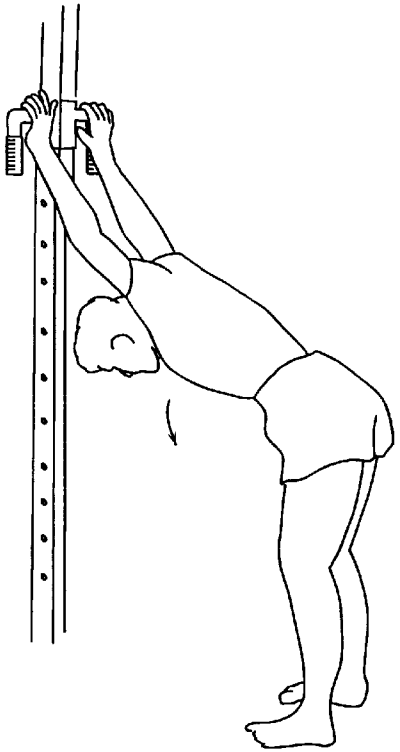
Figure 18D:
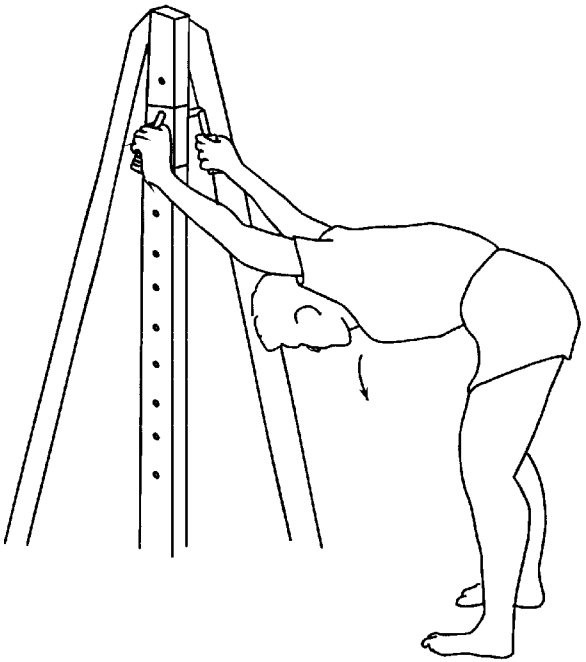
Figure 18G:
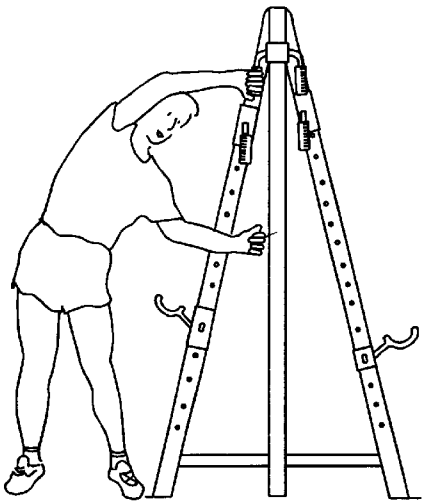
Figure 18H:
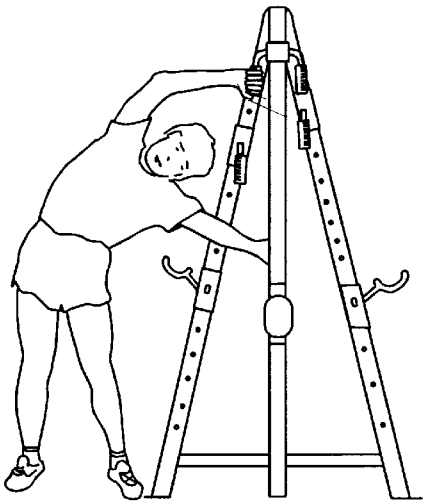
Figure 18I:
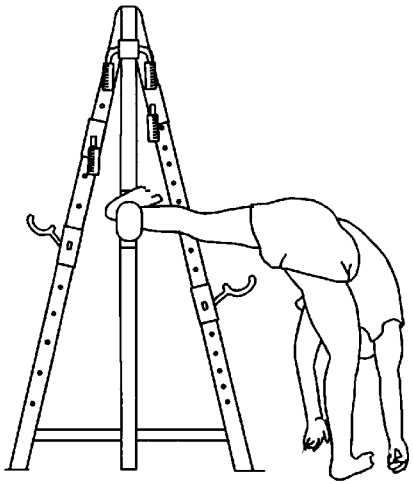
Figure 18J:
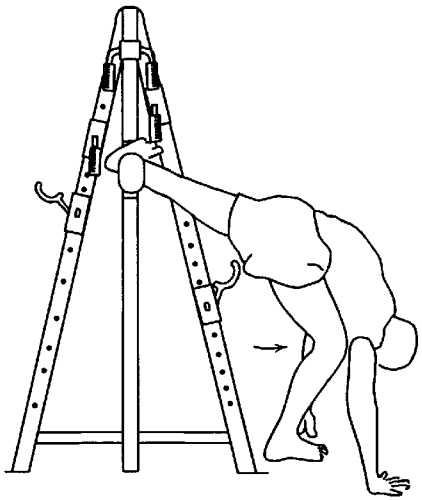

In the preferred embodiment, four (4) foot support members 126 (FIG. 12) are used to removably attached and secure the first angle bracket 146 and the second angle bracket 180 to provide a stable structure as well as to provide a mounting portion for the foot of the user.

A first foot support member 126 removeably connects the lower end portion 162 of support member 158 of angle bracket 146 to the lower end portion 204 of support member 200 of angle bracket 180 by engagement members 136 and 138 be engaged with the mounting brackets 167 of support member 158 and mounting bracket 191 of support member 182, respectively.

A second foot support member 126 removeably connects the lower end portion 162 of support member 158 of angle bracket 146 to the lower end portion 186 of support member 182 of angle bracket 180 by engagement members 136 and 138 be engaged with the mounting brackets 190 of support member 182 and mounting bracket 157 of support member 148, respectively.

A third foot support member 126 removeably connects the lower end portion 186 of support member 182 of angle bracket 180 to the lower end portion 152 of support member 148 of angle bracket 148 by engagement members 136 and 138 be engaged with the mounting brackets 156 of support member 148 and mounting bracket 208 of support member 180, respectively.

A fourth support member 126 removeably connects the lower end portion 152 of support member 14 of angle bracket 146 to the lower end portion 204 of support member 200 of angle bracket 180 by engagement members 136 and 138 be engaged with the mounting brackets 209 of support member 180 and mounting bracket 166 of support member 158, respectively.

To assemble the stretching device 10 of the third embodiment (FIGS. 13–16), the upper support bracket 210 is removed from the second angle bracket 180. Thereafter, the second angle bracket 180 is inserted into the first angle bracket 146 such the lower mounting bracket 216 and disposed above and in contact with the lower mounting bracket 174 of the first angle bracket 146. Thereafter, a bolt (not shown) is passed through openings 175 and 217 of lower support brackets 174 and 216, respectively, to thereby partially secure the first angle bracket 146 to the second angle bracket 180. Thereafter, the upper support bracket 210 of the second angle bracket 180 is re-installed to the support members 182 and 200 whereby the upper support bracket 210 disposed above and in contact with the upper mounting bracket 168 of the first angle bracket 146. Thereafter, a bolt (not shown) is passed through openings 169 and 211 of upper support brackets 168 and 210, respectively, to thereby secure the first angle bracket 146 to the second angle bracket 180: Thereafter, connect of the four foot support members 126 as previously described will provide for a secure and stable structure.

With general reference to FIGS. 17 and 18, a person may stretch various muscles of the leg using any one of the embodiments of the stretching device 12 heretofore described. In use of any of the various embodiments of the stretching device 12, the person may adjust the leg support 72 and/or the hand support 58 (if adjustable version is provided) to a desired height above the floor 12. As shown in FIGS. 17 and 18, a person may perform multiple leg stretching exercises and multiple upper body stretching exercises. While the first embodiment of stretching device 12 (FIG. 1) is intended for a single person, the stretching device 12 of the second embodiment (FIG. 10) and of the third embodiment (FIGS. 13 and 14) enables several people to exercise simultaneously.

Figure 19:
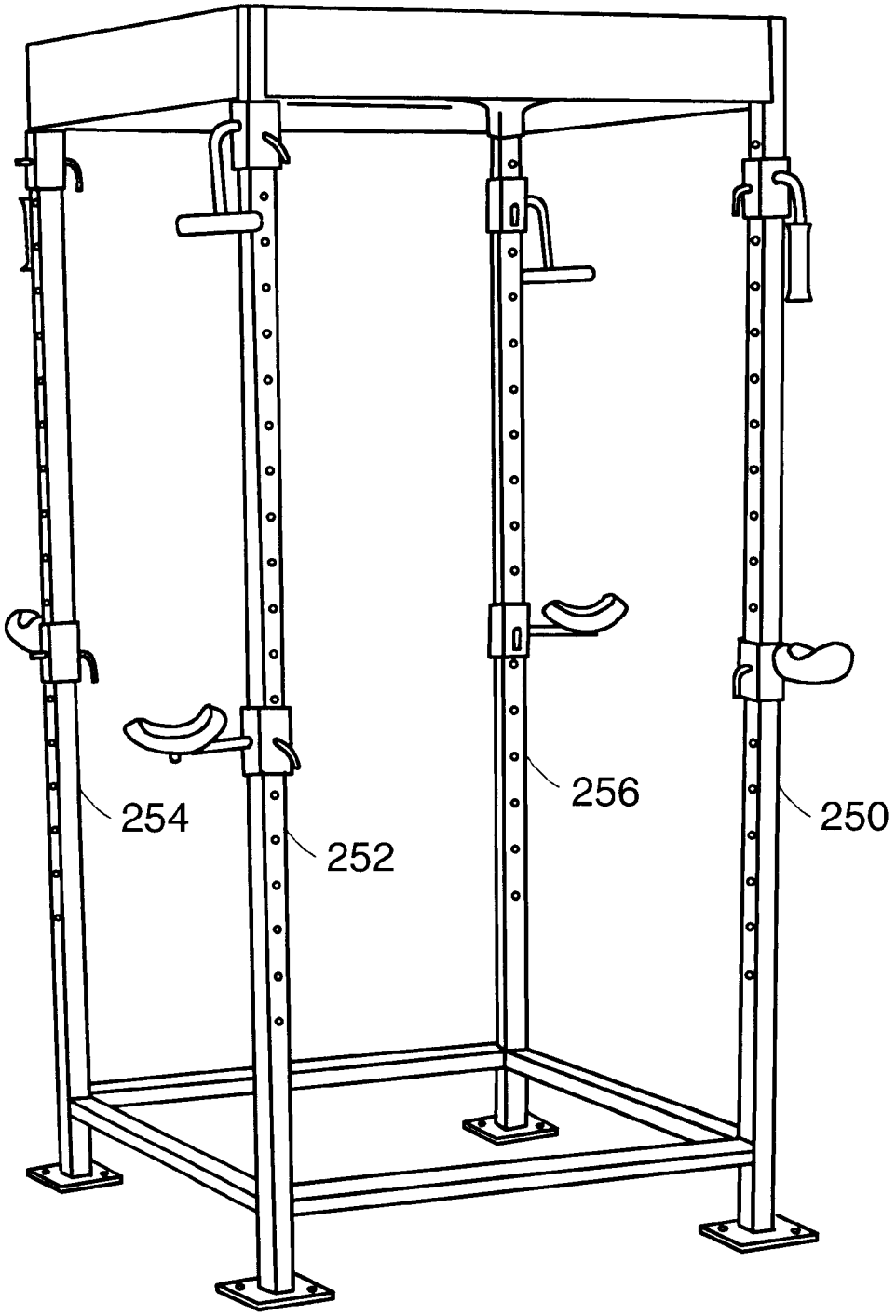
FIGS. 19 and 20 are color copies of photographs of additional embodiments of the stretching device.
Figure 20:
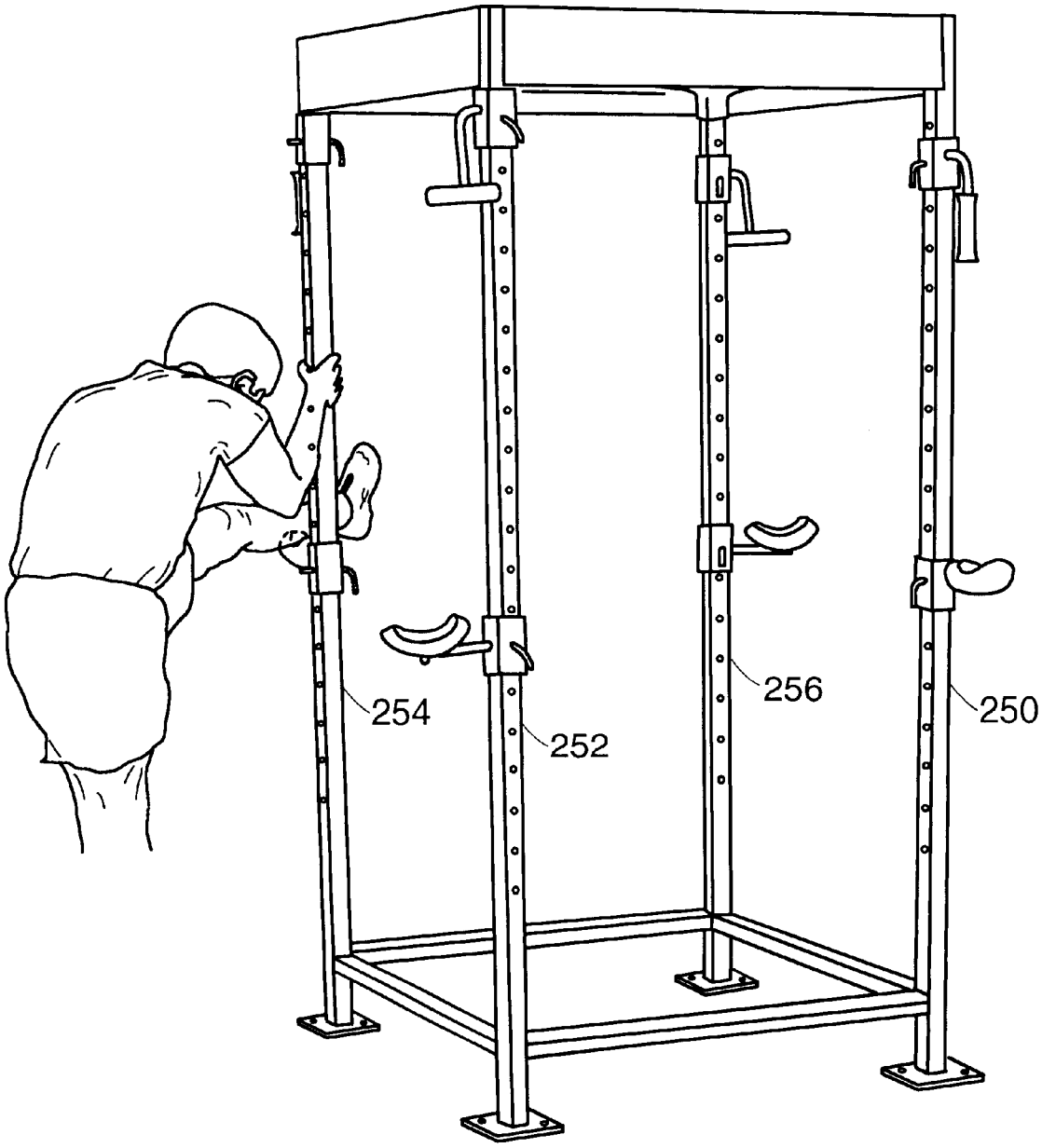

Referring to FIGS. 18 and 19, wherein another embodiment of the stretching device 10 is shown comprising a first support member 250, a second support member 252, a third support member 254, and a fourth support member 256. Each of the first, second, third and fourth support members 250, 252, 254, and 256 further comprise first and second mounting portions 258 and 260. Each of the first, second, third, and fourth support members 250, 252, 254, and 256 further comprise a leg support member 262 moveable by the person from the first mounting portion 258 to the second mounting portion 260. The first support member 250 is engaged to the second support member 252. The second support member 252 is engaged to the third support member 254. The third support member 254 is engaged to the fourth support member 256. The fourth support member 256 is engaged to the first support member 250.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device mounted on a floor to allow a person to perform leg stretching comprising:

(a) an upper bracket member;

(b) first, second, and third main support members each having a lower end portion, a median portion, and an upper end portion; each of said upper end portions being moveably engaged with said upper bracket member from a closed position where said first, second and third main support members are substantially folded upon each other to an open position where said first, second, and third main support members are spaced outward from each other to be placed in stable contact with the floor; each of said median portions having a plurality of spaced mounting portions; and (c) first, second and third leg support members each being adapted to support the leg of the person and to be removably engageable by the person to any one of said plurality of spaced mounting portions of said first, second and third main support members, respectively.

2. The device of claim 1, further comprising a first handle portion engaged with said first main support member and being adapted to be held by the person.

3. The device of claim 2, wherein said first handle portion is disposed at said upper end portion of said first main support member.

4. The device of claim 2, further comprising second handle portion engaged with said second main support member and being adapted to be held by the person.

5. The device of claim 4, further comprising a third handle portion engaged with said third main support member and being adapted to be held by the person.

6. The device of claim 1, further comprising first, second and third cross members engaged with each of said first, second, third main support members, respectively, to secure said first, second, and third main support members in said open position.

7. The device of claim 6, wherein said first, second and third cross members are removably engaged to each of said first, second, third main support members, respectively, to secure said first, second, and third main support members in said open position.

8. The device of claim 7, wherein said first, second and third cross members are engaged to each of said lower end portions of said first, second, third main support members, respectively.

9. The device of claim 1, wherein said first second, third main support members are rotatably engaged with said upper bracket member.

10. The device of claim 9, further comprising a first handle portion engaged with said first main support member and being adapted to be held by the person.

11. The device of claim 10, further comprising a second handle portion engaged with said second main support member and being adapted to be held by the person.

12. The device of claim 11, further comprising a third handle portion engaged with said third main support member and being adapted to be held by the person.

13. The device of claim 12, further comprising first, second arid third cross members engaged with each of said first, second, third main support members, respectively, to secure said first, second, and third main support members in said open position.

14. The device of claim 13, wherein each of said first, second, and third main support members are of elongated shape.

15. The device of claim 14, wherein each of said first, second, and third leg support members are of arcuate shape.

* * * * *